US006505588B2

(12) United States Patent
Dietz

(10) Patent No.: US 6,505,588 B2
(45) Date of Patent: Jan. 14, 2003

(54) INTERNAL COMBUSTION ENGINE WITH AT LEAST TWO CAM SHAFTS ARRANGED ADJACENT TO EACH OTHER IN THE CYLINDER HEAD, PARTICULARLY WITH AN INTAKE CAMSHAFT AND AN EXHAUST CAMSHAFT

(75) Inventor: Joachim Dietz, Frensdorf (DE)

(73) Assignee: INA- Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/120,961

(22) Filed: Apr. 11, 2002

(65) Prior Publication Data

US 2002/0174842 A1 Nov. 28, 2002

(30) Foreign Application Priority Data

Apr. 11, 2001 (DE) ..... 101 18 119

(51) Int. Cl.[7] ..... F01L 1/344

(52) U.S. Cl. ..... 123/90.17; 123/90.34; 123/90.38; 123/193.3; 123/196 M

(58) Field of Search ..... 123/90.15, 90.17, 123/90.31, 90.33, 90.34, 90.38, 193.3, 193.5, 196 M

(56) References Cited

U.S. PATENT DOCUMENTS 5,954,019 A * 9/1999 Yoshikawa et al. ..... 123/90.17
6,035,817 A * 3/2000 Uchida ..... 123/90.17
6,186,105 B1 * 2/2001 Yonezawa ..... 123/90.17
6,289,861 B1 * 9/2001 Suzuki ..... 123/90.17
6,308,672 B1 * 10/2001 Lichti et al. ..... 123/90.17

FOREIGN PATENT DOCUMENTS

| | | |
|---|---|---|
| EP | 0808997 | 11/1997 |
| EP | 1046793 | 10/2000 |
| JP | 4342810 | 11/1992 |

* cited by examiner

*Primary Examiner*—Wellun Lo
(74) *Attorney, Agent, or Firm*—Volpe and Koenig, P.C.

(57) ABSTRACT

An internal combustion engine with two camshafts (4, 5) arranged side by side in the cylinder head (1), each having a mechanism (8, 9) for varying the control timing of gas exchange valves is provided. The feeding and discharge of the hydraulic pressure medium to and from the mechanisms (8, 9) takes place through electromagnetic control valves (15, 16), each including a cartridge which can be inserted into a valve holder (19, 20) and an attached electromagnet (23, 24) which has an electrical socket (27, 28) located on its clear front side (25, 26). The valve holders (19, 20) are constructed as separate flanged connectors which are situated directly above the bearings of the camshafts (4, 5) on the cylinder head of the engine in such a way that the control valves (15, 16) are situated beside each other with their cartridges facing away from each other and with their electromagnets (23, 24) facing each other along a common longitudinal axis running transverse to the longitudinal axis of the camshafts (4, 5).

5 Claims, 3 Drawing Sheets

INTERNAL COMBUSTION ENGINE WITH AT LEAST TWO CAM SHAFTS ARRANGED ADJACENT TO EACH OTHER IN THE CYLINDER HEAD, PARTICULARLY WITH AN INTAKE CAMSHAFT AND AN EXHAUST CAMSHAFT

BACKGROUND

The invention relates to an internal combustion engine with at least two camshafts arranged beside each other in the cylinder head, and it is especially applicable to internal combustion engines with an intake camshaft and an exhaust camshaft.

This type of internal combustion engine is already known from EP 0 945 598 A2. In a special model of this internal combustion engine, the ends of both camshafts, which are each supported in a journal bearing in the cylinder head of the internal combustion engine, are each connected to a mechanism for varying the control timing of the engine's gas exchange valves, each including a drive unit connected through a drive means with the crankshaft of the engine and of an output unit connected to the respective camshafts. Between the drive unit and the output unit of each mechanism, at least two hydraulic compression chambers are constructed in the usual manner, which act in opposition to each other and which can be alternately or simultaneously charged with a pressure medium, thus causing a relative rotation or a hydraulic clamping of the respective camshaft to the crankshaft of the engine. In this way, the feeding and discharge of the hydraulic pressure medium to and from the compression chambers of both mechanisms are each regulated separately by an electromagnetic control valve which is fluidly connected with the compression chambers through the journal bearing of the respective camshaft as well as through pressure medium channels in the camshaft and in the cylinder head of the engine. Each of these electromagnetic control valves consists normally of an electromagnet with an electrical socket on the front and a cartridge which is connected to the electromagnet and which can be inserted into a drilled hole designed as a valve holder in keeping with the usual solution. This hole is incorporated into the cylinder head walls of the engine in the region of the journal bearing of the camshaft running parallel to it, and extends transverse to the crankcase of the engine in order to save space for the positioning of the control valve.

The disadvantage of this familiar engine design is, however, that the electromagnetic control valves for the mechanism for varying the valve control times, in spite of their transverse positioning alongside the cylinder head walls, require an enlarged clearance for the engine in the vehicle, which is not available in every case or can only be accomplished through costly restructuring of the whole engine design.

Moreover, the electromagnets of the control valves and their electrical sockets are exposed to an increased danger of contamination by their unprotected positioning on the engine. In the long term, this can lead to malfunctions or to failure of the electromagnetic control valves and therefore also to failure of the mechanisms for varying the valve control reaction times of the engine.

SUMMARY

The object of the invention is to design an internal combustion engine with at least two camshafts arranged alongside each other in the cylinder head, in particular with an intake camshaft and an exhaust camshaft. This engine only requires a minimum clearance in the vehicle because of a space-saving arrangement of the electromagnetic control valves for the mechanism for varying the valve control reaction times and is distinguished by simple measures for the greatest possible avoidance of failure of the electromagnetic control valves due to contamination.

In accordance with the invention, this object is fulfilled in an internal combustion engine by designing the valve holders of the control valves as separate flanged connectors with a plunge-cut hole. These are attached directly above the journal bearings of the camshafts on the cylinder head of the engine in such a way that the control valves are arranged with their cartridges facing away from each other and with their electromagnets arranged side by side, directly facing each other on a common longitudinal axis running transverse to the longitudinal axis of the camshafts. The electrical sockets of the electromagnets are each arranged parallel to the front side on an extension, facing away from each other, alongside the electromagnets and parallel to the longitudinal axis of the control valves.

In a further embodiment of an internal combustion engine built according to this invention, the valve holders of the control valves preferably feature a trapezoid-shaped cross sectional profile and are bolted together by the larger of their two parallel surfaces on the level facing surface of a cylinder head cover, which can preferably be mounted on the engine's cylinder head. For this purpose, several additional clamping collars for bolts are molded onto the larger parallel surfaces of the valve holders, which can be screwed into corresponding threaded holes in the facing surface of the cylinder head cover. A trapezoid-shaped cross sectional profile of the valve holders has proven to be the most advantageous for saving both space and weight. It can also be replaced, however, by another suitable cross sectional profile, for example, by a half round or a rectangular cross sectional profile.

Another significant characteristic of the internal combustion engine constructed in accordance with this invention is that a bearing half of the journal bearings in the camshafts, constructed in the familiar fashion of at most two parts, is integrated into each cylinder head cover and is connected through pressure medium conduits incorporated in the cylinder head cover as well as in the valve holders with the plunge-cut holes in each of the valve holders situated above the journal bearing. Starting from the plunge-cut holes for the control valves in the valve holders, the feeding and discharge of the hydraulic pressure medium to and from the compression chambers of the mechanism for varying the valve control times takes place through these pressure medium conduits as well as through the journal bearings of the camshafts and through the pressure medium channels located in the camshafts. As a result, the pressure medium conduits incorporated into the valve holders and the cylinder head covers are each formed primarily by two of the plunge-cut holes in the respective valve holders which proceed perpendicularly through the cylinder head cover and meet inside of the journal bearing of the camshafts in corresponding ring canals on the ends of the camshafts. These ring canals are connected to the pressure medium canals in the camshafts. A design of this type, however, with the described arrangement and construction of the control valves and their valve holders, should not be limited only to internal combustion engines having journal bearings for the camshafts integrated in the cylinder head cover. It is also feasible, by analogy, for use with small adjustments, for internal combustion engines with camshaft journal bearings situated separately from the cylinder head cover. It is also conceivable to construct the control valves, which can be inserted into the valve holders and are preferably bolted to them, in one piece with the valve holders by utilizing an inseparable connection.

With regard to the electrical sockets protruding from the front sides of the control valves' electromagnets which directly face each other in the assembly position, these electrical sockets are situated, due to space requirements, above an extension on a longitudinal axis beside the electromagnets or in a horizontal plane between the electromagnets and the mechanisms for varying the valve control times, and are therefore difficult to access. It is recommended, in the design of an internal combustion engine constructed in accordance with this invention, that these sockets be arranged in such a way that the clearance from the surface of the electromagnets makes it possible to use these surfaces as bearing surfaces during the installation of the cable plug. This means that the clearance of the sockets from the surfaces of the electromagnets corresponds roughly to the thickness of the casing of the cable plug, so that it is possible during manual assembly of the cable plug to establish a secure plug connection between the cable plug and the electrical socket of the electromagnets, without being able to see it directly, by drawing the cable plug up onto the surfaces of the electromagnets and then pushing the cable plug in a straight line along the surfaces.

Furthermore, it is also recommended for the construction of an internal combustion engine in accordance with this invention, that the mechanisms for varying the valve control timing, along with their drive means as well as the valve holders and the control valve electromagnets, including their electrical sockets, be provided with additional protection from contamination by a plastic casing. The cross sectional shape of this plastic casing results primarily from conforming to the contour of the longitudinal section through the end of the engine's cylinder head with the mechanism along the longitudinal axis of the camshaft, and is preferably secured by a plug-and-socket connection on the engine's cylinder head. It is also possible, however, instead of using plastic, to use a casing made of a light metal or another suitable material which can also be secured by a bolted connection or something similar on the engine's cylinder head.

An internal combustion engine, constructed in accordance with this invention, that has at least two camshafts located beside each other in the cylinder head, particularly with an intake camshaft and an exhaust camshaft, therefore features an advantage over the known state-of-the-art internal combustion engines, in that it is no longer necessary to make alterations for the clearance of the engine or to restructure nearby elements of the engine. This is because of the space-saving arrangement of the electromagnetic control valves for the mechanism for varying the valve control timing. The arrangement of the electromagnetic control valves in separate valve holders constructed as flanged connectors on the cylinder head of the engine also has the advantage of making it easy to access them when servicing the engine and making it very simple to clean or replace them. Moreover, by the additional encasement in plastic of the mechanisms, the valve holders and the electromagnets of the control valves including their sockets, a simple measure is taken for preventing contamination-related failures of both the electromagnetic control valves and the mechanisms for varying the valve control reaction times.

BRIEF DESCRIPTION OF THE DRAWINGS

The invention is explained in more detail in the following on the basis of a preferred embodiment schematically in the accompanying drawing. In the drawings.

DETAILED DESCRIPTION OF THE PREFERRED EMBODIMENTS

Figure 1:
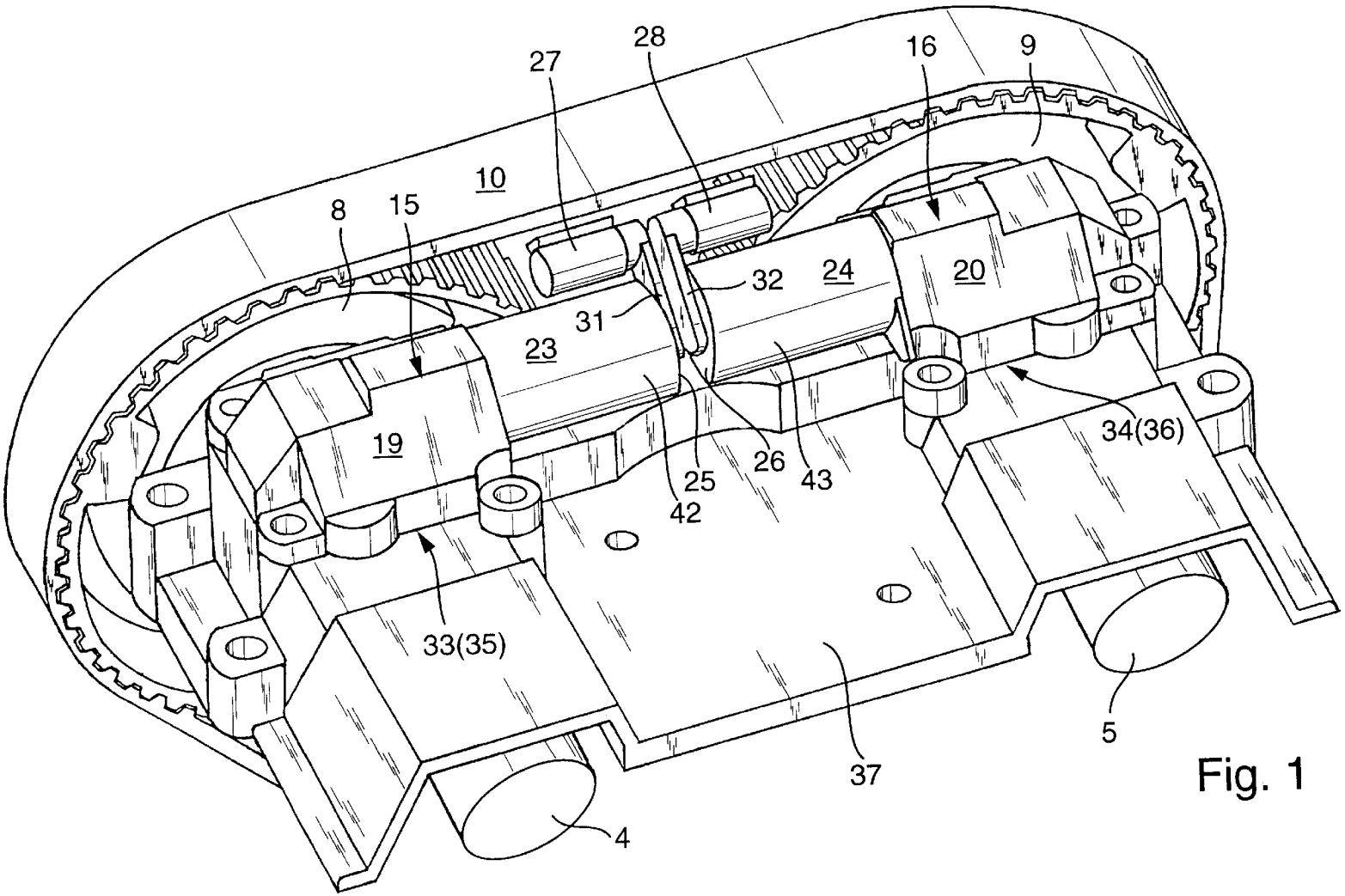
FIG. 1 is a partial perspective representation of a cylinder head equipped with two camshafts arranged alongside each other in an internal combustion engine constructed in accordance with the present invention.
Figure 2:
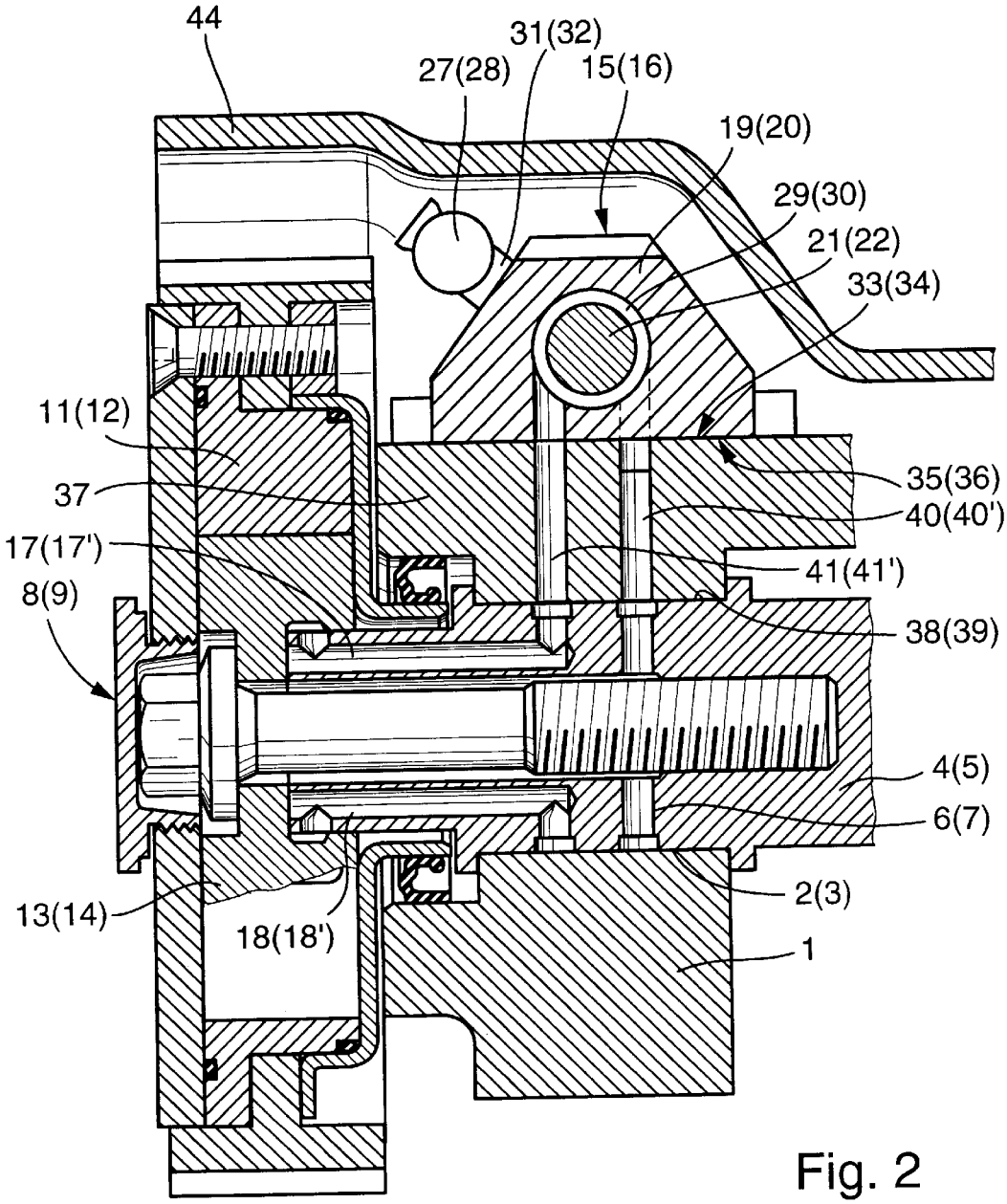
FIG. 2 is a partial cross-sectional view of a longitudinal section along the longitudinal axis of a camshaft through the cylinder head of an internal combustion engine constructed in accordance with the present invention.

From FIGS. 1 and 2, one can clearly see the cylinder head 1 of an internal combustion engine in which two camshafts 4, 5, one designed as an intake camshaft, the other as an exhaust camshaft, are situated beside each other. Here it can be clearly seen that hydraulic mechanisms 8, 9 for varying the control timing of the gas exchange valves of the engine is secured to the ends 6, 7 of both camshafts 4, 5, which are each supported by journal bearings 2, 3 in the cylinder head 1 of the engine. Each of these mechanisms include a drive unit 11, 12 connected via a drive means 10 with the crankshaft of the engine (which is not portrayed) and to a torque-proof output unit 13, 14 connected to the respective camshaft 4, 5.

These mechanisms 8, 9 are constructed as so-called rotary piston regulators in the depicted embodiment, whose drive unit 11, 12 is constructed of as a hollow cylindrical stator with several radial boundary walls and whose output unit 13, 14 is constructed of as a rotor with several blades. Next to these mechanisms 8, 9, several compression chambers that work in opposition to each other and that can be charged alternately or simultaneously with a hydraulic pressure medium, are constructed between the drive unit 11, 12 and the output unit 13, 14 by having the blades of the rotor in the space between the radial boundary walls of the stator divide each of these spaces into two compression chambers.

The feeding and discharge of the hydraulic pressure medium to and from the compression chambers of both mechanisms 8, 9 takes place through the journal bearings 2, 3 of the camshafts 4, 5 as well as through the pressure medium channels 17, 17' or 18, 18' situated in the camshafts 4, 5 and is separately regulated for each mechanism 8, 9 by an electromagnetic control valve 15, 16, each including a cartridge 21, 22 which can be inserted into a valve holder 19, 20 and an electromagnet 23, 24 connected to this which has an electrical socket 27, 28 located on its clear front side 25, 26.

It can also be seen from FIGS. 1 and 2 that the valve holders 19, 20 of the control valves 15, 16, in accordance with this invention, are constructed as separate flanged connectors with a plunge-cut hole 29, 30, which are secured directly over the journal bearings 2, 3 of the camshafts 4, 5 in such a way on the engine's cylinder head 1 so that the control valves 15, 16 are situated beside each other with their cartridges 21, 22 facing away from each other and with their electromagnets 23, 24 directly facing each other on a common longitudinal axis running transverse to the longitudinal axis of the camshafts 4, 5. Since such an arrangement of the control valves 15, 16 with the usual socket on the front for their electromagnets 23, 24 would not be possible due to lack of space, the sockets 27, 28 of the electromagnets 23, 24 are each arranged, therefore, in accordance with this invention, on an extension 31, 32 running parallel to the electromagnets' front side 25, 26, facing away from each other beside the electromagnets 23, 24 as well as parallel to the longitudinal axis of the control valves 15, 16. It then becomes especially clear from FIG. 2 that the extensions 31, 32 for the sockets 27, 28 feature a pivoted position in the direction of the mechanisms 8, 9 for additional space savings in the arrangement of the control valves 15, 16. This position situates the sockets 27, 28 in a horizontal plane between the mechanisms 8, 9 and the electromagnets 23, 24 of the control valves 15, 16. The increased difficulty of access to the sockets 27, 28 that this causes is ameliorated by situating the sockets 27, 28 with spaced from the surfaces 42, 43 of the electromagnets 23, 24 that corresponds roughly to the thickness of the casing of the cable plugs to be mounted, so that the surfaces 42, 43 can be used as bearing surfaces during assembly of the plug-and-socket connection between the cable plug and the sockets 27, 28.

Furthermore, it can be concluded from the representation in FIGS. 1 and 2 that the valve holders 19, 20 constructed as flanged connectors feature a space- and weight-saving, trapezoid-shaped cross sectional profile and are bolted together with the larger of their two parallel surfaces 33, 34 on a level facing surface 35, 36, which is found in the illustration on a cylinder head cover 37 which can be attached to the cylinder head 1.

Figure 3:
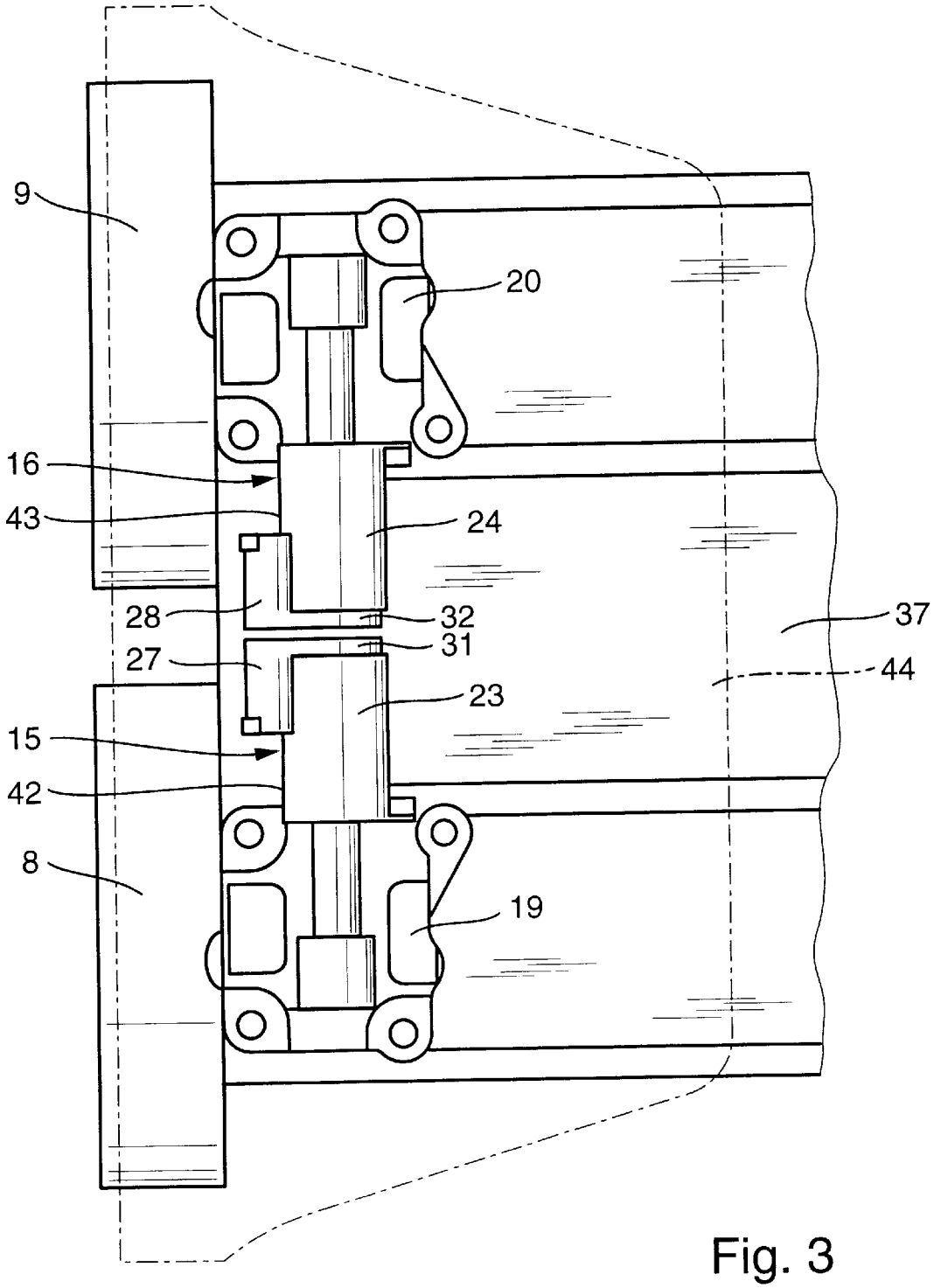
FIG. 3 is a top view of a partial view of the cylinder head of an internal combustion engine constructed in accordance with the present invention.

As indicated in FIG. 3, bearing halves 38, 39 of the journal bearings 2, 3 of the camshafts 4, 5 are each integrated into the cylinder head cover 37. Each of these bearing halves are connected through the pressure medium conduits 40,40', 41,41' incorporated into the cylinder head cover 37 as well as in the valve holders 19, 20 with the respective plunge-cut holes 29, 30 of the valve holders 19, 20 situated over the journal bearings 2, 3. These pressure medium conduits 40, 40', 41, 41' are primarily formed from the plunge-cut holes 29, 30 of each of the holes starting at the valve holders 19, 20 and going through the cylinder head cover 37, and which meet in corresponding ring canals in the camshafts 4, 5, which are not illustrated in more detail, and which are connected with the pressure medium channels 17, 17' and 18, 18' leading to the compression chambers of the mechanisms 8, 9.

In addition, the mechanisms 8, 9 with their drive means 10 as well as the valve holders 19, 20 and the electromagnets 23, 24, including their sockets 27, 28, are provided with a plastic casing 44, as indicated in FIGS. 2 and 3, for protection from contamination and which is secured with a plug-and-socket connection on the cylinder head cover 1 and on the cylinder head cover 37 of the internal combustion engine.

REFERENCE NUMBERS

1 Cylinder Head
2 Journal Bearing
3 Journal Bearing
4 Camshaft
5 Camshaft
6 End
7 End
8 Mechanism
9 Mechanism
10 Drive Means
11 Drive Unit
12 Drive Unit
13 Output Unit
14 Output Unit
15 Control Valve
16 Control Valve
17 Pressure Medium Channel
17' Pressure Medium Channel
18 Pressure Medium Channel
18' Pressure Medium Channel
19 Valve Holder
20 Valve Holder
21 Cartridge
22 Cartridge
23 Electromagnet
24 Electromagnet
25 Front Side
26 Front Side
27 Socket
28 Socket
29 Plunge-cut Hole
30 Plunge-cut Hole
31 Extension
32 Extension
33 Parallel Surface
34 Parallel Surface
35 Facing Surface
36 Facing Surface
37 Cylinder Head Cover
38 Bearing Half
39 Bearing Half
40 Pressure Medium Conduit
40' Pressure Medium Conduit
41 Pressure Medium Conduit
41' Pressure Medium Conduit
42 Surface
43 Surface
44 Plastic Casing

What is claimed is:

1. An internal combustion engine with at least two camshafts arranged beside each other in a cylinder head, comprising an intake camshaft and an exhaust camshaft, secured to an end (6, 7) of each of the camshafts (4, 5), each of which is supported by a journal bearing (2, 3) in the cylinder head (1) of the engine, is a hydraulic mechanism (8, 9) for varying control timing of gas exchange valves of the engine, the mechanisms (8, 9) each include a drive unit (11, 12) connected by a drive means (10) with a crankshaft of the engine and an output unit (13, 14) connected in a rotatably fast manner with the respective camshaft (4, 5), between the drive unit (11, 12) and the output unit (13, 14) of each of the mechanisms (8, 9), at least two hydraulic chambers working in opposition to each other are provided, which can be charged alternately or simultaneously with a hydraulic pressure medium, feeding and discharge of the hydraulic pressure medium to and from the hydraulic chambers of each of the mechanisms (8, 9) takes place through a respective electromagnetic control valve (15, 16) via the respective journal bearing (2, 3) of the camshaft (4, 5) as well as through pressure medium channels located in the camshafts and in the engine cylinder head (1), the control valves (15, 16) each include a cartridge (21, 22) that can be inserted into a respective valve holder (19, 20) connected to an electromagnet (23, 24), having an electrical socket (27, 28) on a front side (25, 26) thereof, the valve holders (19, 20) of the control valves (15, 16) are constructed as separate flanged connectors with a plunge-cut hole (29, 30), and which are secured directly above the journal bearings (2, 3) of the camshafts (4, 5) on the cylinder head (1) of the engine, the control valves (15, 16) are located relative to each other with the respective cartridges (21, 22) facing away from each other and with the respective electromagnets (23, 24) facing each other generally along a common longitudinal axis running transverse to a longitudinal axis of the camshafts (4, 5), and the sockets (27, 28) of the electromagnets (23, 24) are each situated over on an extension (31, 32) that extends parallel to the front sides (25, 26), facing away from each other, adjacent to the electromagnets (23, 24), as well as parallel to the longitudinal axis of the control valves (15, 16).

2. The internal combustion engine in accordance with claim 1, wherein the valve holders (19, 20) for the control valves (15, 16) have a trapezoid-shaped cross sectional profile having two parallel surfaces, are bolted to a level facing surface (35, 36) of a cylinder head cover (37), and are mounted on the cylinder head (1) of the engine by the larger of the two parallel surfaces (33, 34).

3. The internal combustion engine in accordance with claim 2, wherein the journal bearings (2, 3) of the camshafts (4, 5) each have a bearing half (38, 39) that is integrated into the cylinder head cover (37) and are connected through pressure medium conduits (40, 40', 41, 41') located therein and the valve holders (19, 20) with the plunge-cut holes (29, 30) in the valve holders (19, 20).

4. The internal combustion engine in accordance with claim 1, wherein the sockets (27, 28) of the electromagnets (23, 24) of the control valves (15, 16) are arranged such that clearances from adjacent surfaces (42, 43) of the electromagnets (23, 24) are small enough so that the surfaces (42, 43) provide support during installation of cable plugs.

5. The internal combustion engine in accordance with claim 1, wherein the mechanisms (8, 9) with the drive means(10), the valve holders (19, 20) and the electromagnets (23, 24) of the control valves (15, 16), including the electrical sockets (27, 28), are provided with a plastic casing (44) for protection from contamination.

* * * * *